US006039611A

United States Patent [19]

Yang

[11] Patent Number: 6,039,611

[45] Date of Patent: Mar. 21, 2000

[54] CONNECTOR

[75] Inventor: George Yang, Shih-Lin District, Taiwan

[73] Assignee: All Best Electronics Co., Ltd., Taipei, Taiwan

[21] Appl. No.: 09/334,716

[22] Filed: Jun. 16, 1999

[51] Int. Cl.[7] ..... H01R 13/502

[52] U.S. Cl. ..... 439/701; 439/942

[58] Field of Search ..... 439/701, 942, 439/660, 78, 80

[56] References Cited

U.S. PATENT DOCUMENTS

| | | | |
|---|---|---|---|
| 4,026,625 | 5/1977 | Roiko et al. | 439/942 |
| 4,099,822 | 7/1978 | Carlisle et al. | 439/942 |
| 5,954,544 | 9/1999 | Yang | 439/701 |

*Primary Examiner*—Hien Vu

*Attorney, Agent, or Firm*—Pro-Techtor International Services

[57] ABSTRACT

A connector including a plastic body, a steel case housing a front part of the plastic body, an insertion body assembled to a rear end of the plastic body with insertion terminals on the plastic body separately located in terminal slots on the insertion body. Two cables including many conductors are symmetrically connected to upper and lower sides of the insertion body with bared front ends of the conductors separately located in the terminal slots on the insertion terminals. Two covers with forward projected pressing ribs are firmly covered onto the cables with the pressing ribs located in the terminal slots of the insertion body above the bared front ends of the conductors and the insertion terminals to tightly press them together. The covers and their pressing ribs are fixedly connected to the insertion body and the terminal slots by means of radio heating, so that each bared front end of the conductor is located in one terminal slot to tightly contact with only one insertion terminal without the risk of short circuit.

1 Claim, 6 Drawing Sheets

A–A'

CONNECTOR

BACKGROUND OF THE INVENTION

The present invention relates to an improvement made to a connector, and more particularly to a connector that can be quickly manufactured and assembled without the need of soldering and is therefore completely free from any short circuit at contact points thereof.

Most of the connectors currently widely used with computers and/or video products include a steel case and a plastic body. The steel case houses a front part of the plastic body. Upper and lower rows of insertion terminals are provided to project from front surface of the plastic body.

Rear ends of these insertion terminals are individually connected to corresponding leads in a whole bundle of interconnecting conductors by soldering. This type of connector is difficult to manufacture due to the inconvenient and time-consuming soldering operation for individual insertion terminals. When such type of connector is to be used with a desktop computer, it usually has a volume big enough for it to be manufactured without too much difficulty. However, when it is to be used with a notebook computer, LCD, etc., it must have a reduced volume that would inevitably cause difficulty in soldering individual leads to insertion terminals. Much more time is needed for soldering while short circuit might very possibly occur at soldered joints.

FIGS. 1 and 2 are disassembled perspective and partially sectional top views, respectively, of a conventional connector developed to solve the above-mentioned problem existing in the connectors of early stages. As shown, the conventional connector includes a steel case 1, a plastic body 5, and an insertion body 6. The steel case 1 houses a front part of the plastic body 5, and the insertion body 6 is assembled to the plastic body 5 by inserting it to a rear end of the plastic body 5. Upper and lower rows of alternately arranged insertion terminals 51 are provided at front surface of the plastic body 5. The plastic body 5 has two rearward extended side walls 52 each of which has a guiding rail 53 formed at an inner surface thereof. And a retaining hole 54 is formed in each guiding rail 53 at suitable position. The insertion body 6 is formed on top and bottom front surfaces with a plurality of terminal slots 61 corresponding to the insertion terminals 51 on the plastic body 5 and on two lateral side surfaces with two protrusions 62 corresponding to the retaining holes 54 in the guiding rails 53 of the plastic body 5. When the insertion body 6 is assembled to the rear end of the plastic body 5 via the two guiding rails 53, rear ends of the insertion terminals 51 are inserted into their respective corresponding terminal slots 61 on the insertion body 6. Moreover, partitioning ribs 63 are provided between rear ends of adjacent terminal slots 61 and separating strips 64 are provided at a rear end of the insertion body 6 corresponding to the partitioning ribs 63 with a receiving recess 65 transversely extending between the corresponding partitioning ribs 63 and separating strips 64.

There are interconnecting cables 7 connected to a rear end of the connector and each includes multiple conductors 71 that are spaced corresponding to the insertion terminals 51 and fixed in place by clamping them between two clamping pieces 73 that are then set in the receiving recesses 65 with bared front ends 72 of the conductors 71 projecting from the clamping pieces 73 into the terminal slots 61 to contact rear ends of the insertion terminals 51 in the terminal slots 61 between the partitioning ribs 63. The bared conductors 72 and the insertion terminals 51 can then be electrically connected by soldering at a time. When the insertion body 6 is inserted into the plastic body 5 before the soldering, the rear ends of the insertion terminals 51 are located at middle portion between adjacent partitioning ribs 63 and the bared front ends 72 of the conductors 71 are projected from adjacent partitioning ribs 63 to locate above the rear ends of the insertion terminals 51 in the terminal slots 61. Therefore, the soldering for connecting the insertion terminals 51 and the bared ends 72 of the conductors 71 can be done easily.

Although the above-described connector is good for use, it still has following disadvantages:

1. The clearance between two adjacent bared front ends 72 of the conductors 71 is so small that it is inevitable short circuit will dangerously occur at some points when the bared front ends 72 are connected to the rear ends of the insertion terminals 51 by soldering, particularly in a tin solder wetting step during the soldering. To avoid such possible short circuit, highly skilled soldering workers are required that would increase the manufacturing cost of the connectors. Moreover, signal transmission efficiency would be adversely affected due to such possible short circuit.
2. The bared front ends 72 of the conductors 71 are located above the rear ends of the insertion terminals 51 without seated in the terminal slots 61. Therefore, the bared ends 72 tend to shift and deviate from their original position in a pressing step during the soldering. This deviation of the bared ends 72 from position will also cause short circuit and accordingly difficulty in quality control of the connectors.

It is therefore desirable to develop a connector that can be easily produced without the step of soldering the conductors and the insertion terminals, so that the connector can be more quickly produced and the possible short circuit at soldered joints can be avoided.

SUMMARY OF THE INVENTION

It is a primary object of the present invention to provide an improved connector that can be more easily and quickly manufactured and avoid short circuit at soldered joints.

To achieve the above and other objects, the connector of the present invention includes two cover members in addition to a plastic body, a steel case housing a front part of the plastic body, an insertion body inserted into a rear end of the plastic body, and two interconnecting cables connected to the insertion body. The connector of the present invention is characterized in that the insertion body is assembled to the rear end of the plastic body with insertion terminals on the plastic body separately located in terminal slots on the insertion body, that the two cables include many conductors and are symmetrically connected to upper and lower sides of the insertion body with bared front ends of the conductors separately located in the terminal slots on the insertion body over the insertion terminals, that the two covers have forward projected pressing ribs and are firmly covered onto two sides of the cables with the pressing ribs separately located in the terminal slots of the insertion body above the bared front ends of the conductors and the insertion terminals to tightly press them together. The covers and their pressing ribs are fixedly connected to the insertion body and the terminal slots by means of radio heating, so that each bared front end of the conductor is fixedly located in one terminal slot to tightly contact with only one insertion terminal without the risk of short circuit.

BRIEF DESCRIPTION OF THE DRAWINGS

The above and other objects as well as the features of the present invention can be best understood by referring to the following detailed description of the preferred embodiments and the accompanying drawings wherein.

DETAILED DESCRIPTION OF THE PREFERRED EMBODIMENTS

Figure 1:
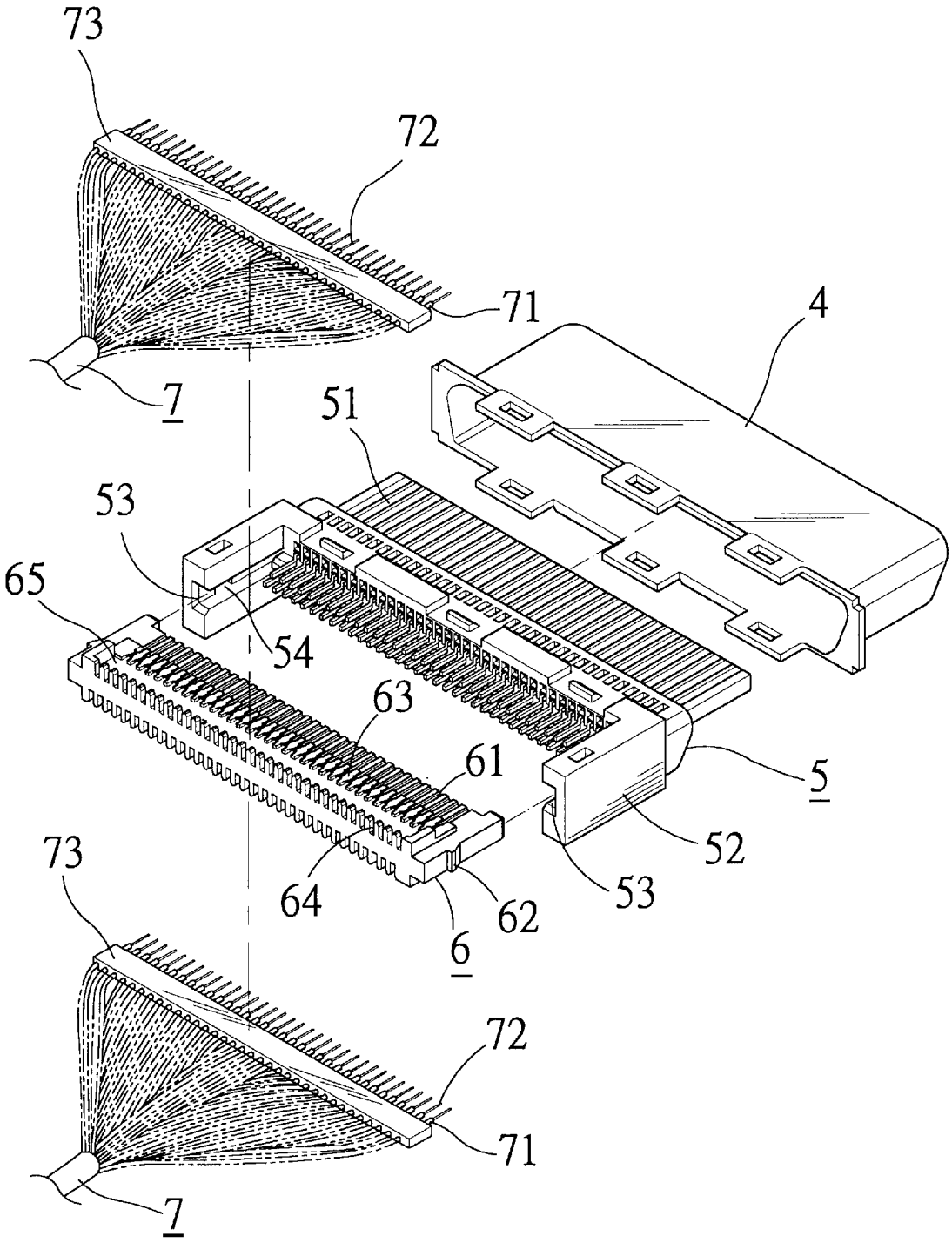
(PRIOR ART) Fig.1
FIG. 1 is a disassembled perspective of a conventional connector.
Figure 2:
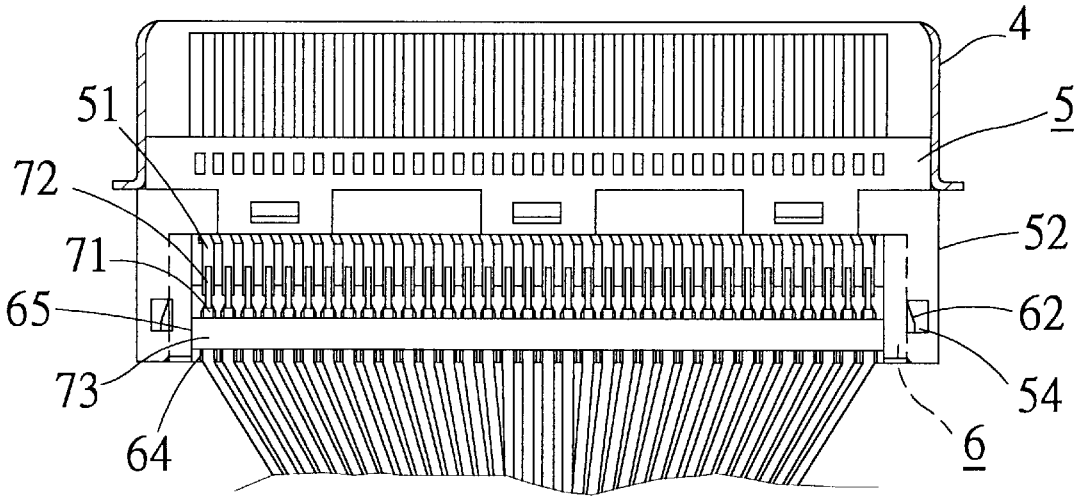
(PRIOR ART) Fig.2
FIG. 2 is a partially sectional top view of the conventional connector of FIG. 1.
Figure 3:
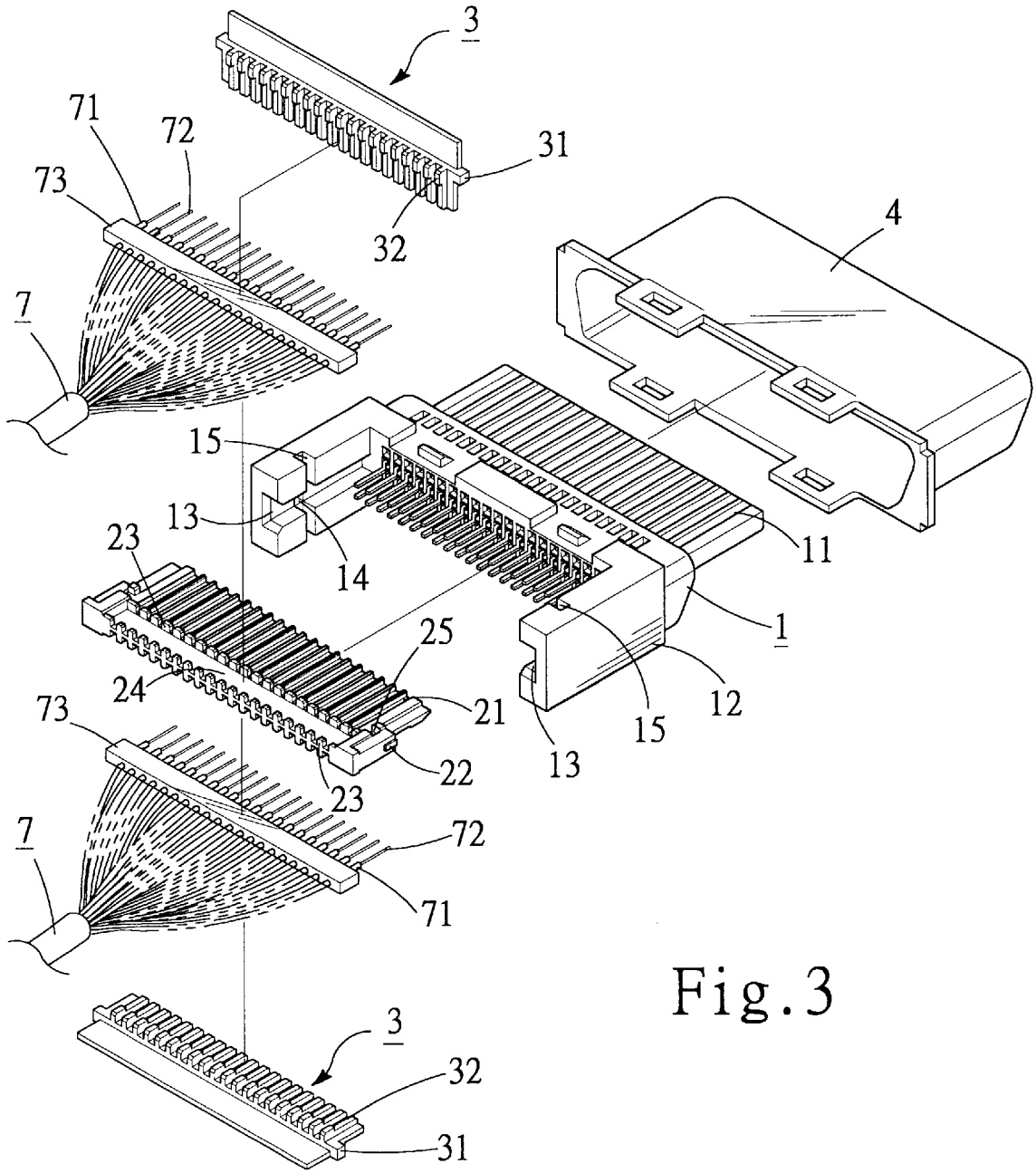
FIG. 3 is a disassembled perspective view of a connector according to the present invention.
Figure 4:
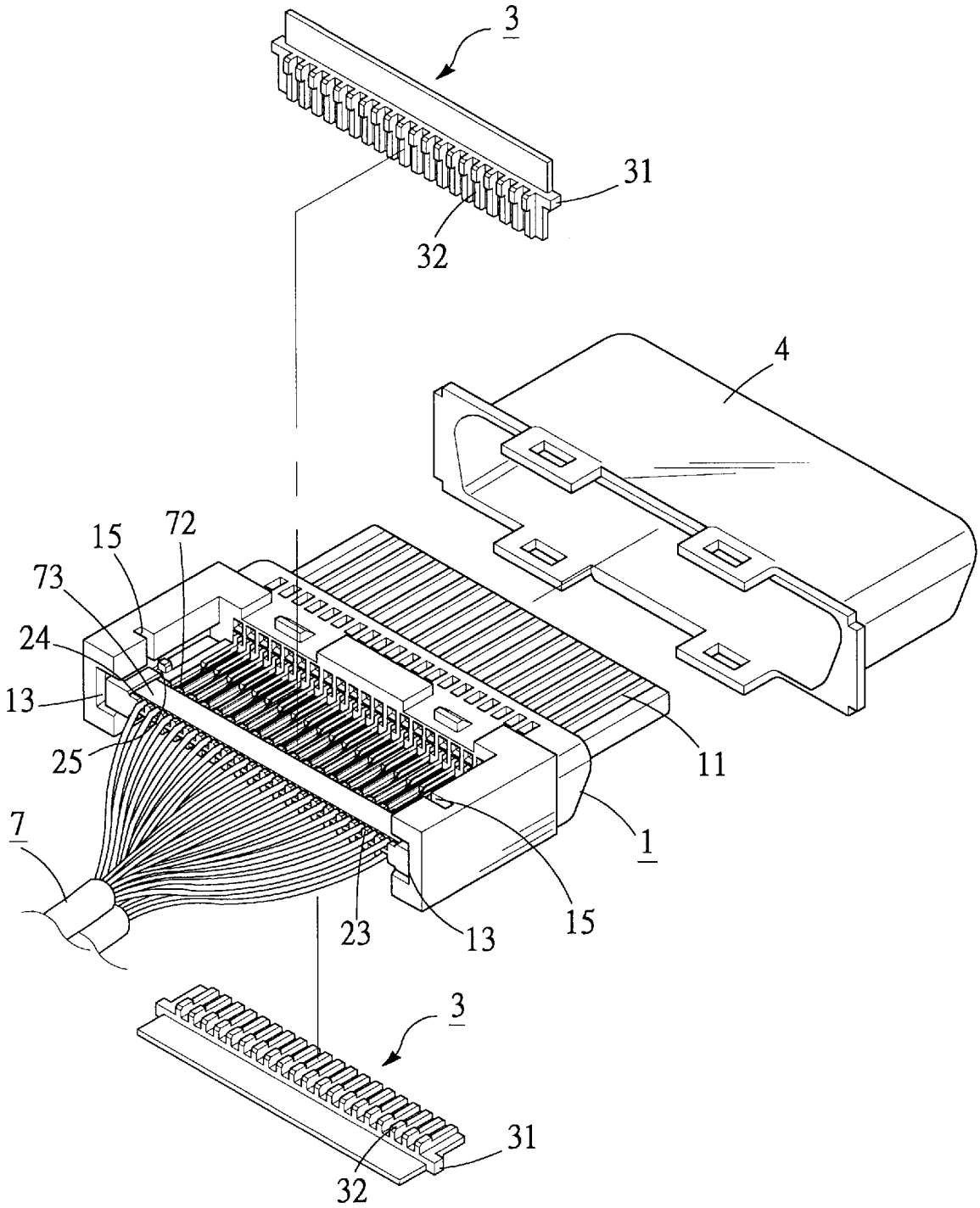
FIG. 4 partially assembled perspective view of the connector of FIG. 3.

Please refer to FIGS. 3 and 4 that are disassembled perspective and partially assembled perspective views, respectively, of a connector according to the present invention. As shown, the connector includes a plastic body 1, an insertion body 2, two covers 3, a steel case 4, and two interconnecting cables 7. The steel case 4 houses a front part of the plastic body 1 and the insertion body 2 is assembled to a rear end of the plastic body 1.

The plastic body 1 includes an upper and a lower row of alternately arranged insertion terminals 11 projected from a front surface thereof and two rearward extended side walls 12. Each of the side walls 12 is formed at an inner surface with a guiding rail 13 that is further formed at a suitable position with a retaining hole 14. Two vertically extended insertion slots 15 are symmetrically provided at inner surfaces of the two side walls 12 at predetermined positions.

The insertion body 2 is formed at two lateral side surfaces with two protrusions 22 for engaging into the retaining holes 14 in the guiding rails 13 of the plastic body 1 when the insertion body 2 is assembled to the plastic body 1 by sliding it forward along the two guiding rails 13. The insertion body 2 is formed at top and bottom front surfaces with a plurality of terminal slots 21 corresponding to the insertion terminals 11. When the insertion body 2 is assembled to the rear end of the plastic body 1, rear ends of the insertion terminals 11 are located in their respective corresponding terminal slots 21. Moreover, rear ends of the terminal slots 21 on the insertion body 2 are well separated from one another by partitioning ribs 23 respectively located between two adjacent terminal slots 21. Two receiving recesses 24 are left on top and bottom surfaces of the insertion body 2 to transversely extend the partitioning ribs 23, so that each of the partitioning ribs 23 is divided into two disconnected sections. And, two recesses 25 are provided on upper and lower surfaces of the insertion body 2 at two lateral sides corresponding to the insertion slots 15 on the plastic body 1.

The two covers 3 are symmetrically formed. The cover 3 is provided at each lateral end with a centered projection 31 corresponding to the vertical insertion slot 15 on the plastic body 1 and at a front edge with a plurality of forward projected pressing ribs 32 corresponding to the terminal slots 21 on the insertion body 2.

The interconnecting cable 7 each includes a plurality of conductors 71 that are arranged in advance to separately correspond to the insertion terminals 11 and are fixed in place by clamping them between two transversely extended clamping pieces 73, such that the conductors 71 are equally spaced and extend a suitable length from a front side of the clamping pieces 73. Front ends of the conductors 71 extended from the clamping pieces 73 are stripped to become equally spaced bare conductors 72.

Figure 5:
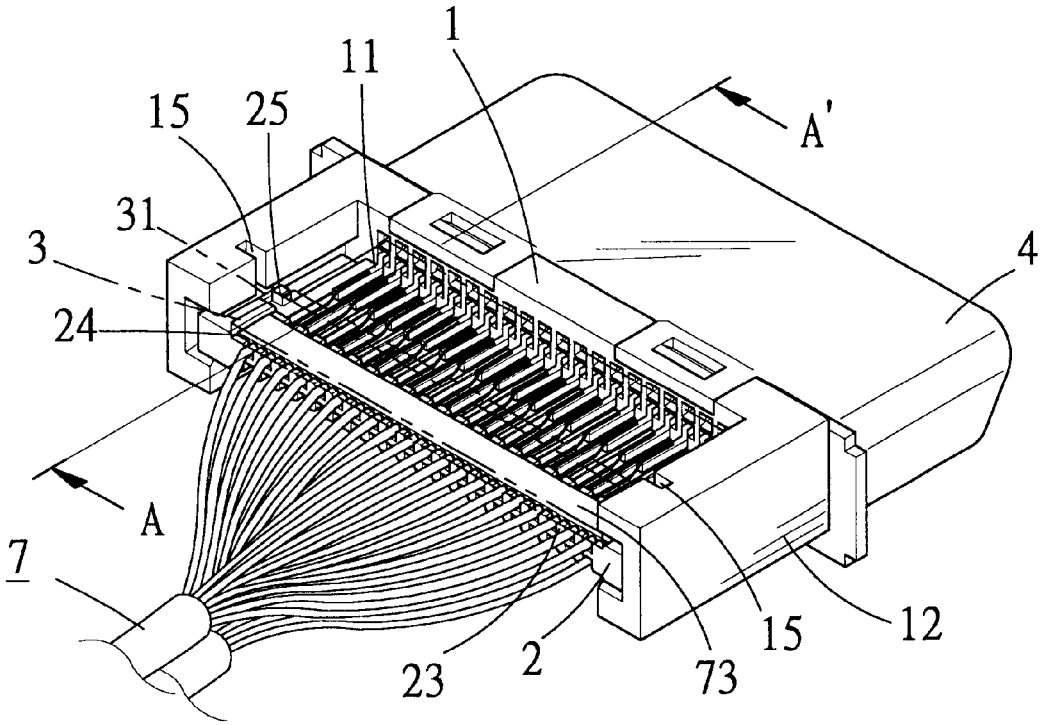
FIG. 5 is a fully assembled perspective view of the connector of FIG. 3.

To form a complete connector of the present invention, the insertion body 2 is first inserted into the plastic body 1, and then the clamping pieces 73 with conductors 71 clamped therebetween are set in the receiving recesses 24 on the insertion body 2, as illustrated in FIG. 4, so that the conductors 71 are separately located between two adjacent partitioning ribs 23 with the bare conductors 72 locating on and contacting with rear ends of insertion terminals 11 correspondingly located in the terminal slots 21. Thereafter, the two covers 3 are assembled to the plastic body 1 and the insertion body 2 to locate on the clamping pieces 73 by aligning the lateral projections 31 with the vertical insertion slots 15 on the plastic body 1, so that the lateral projections 31 finally engage with the recesses 25 on the insertion body 2 and are retained therein. At this point, the pressing ribs 32 forward projected from the covers 3 are located in their respective corresponding terminal slots 21 above the bare conductors 72 and the insertion terminals 11 in the same terminal slots 21. Finally, rear edges of the covers 3 are firmly connected to the rear sections of the partitioning ribs 23 and the pressing ribs 32 in front of the covers 3 to front sections of the partitioning ribs at two sides of the terminal slots 21 by means of radio heating. The front part of the plastic body 1 is then housed by the steel case 4. FIG. 5 illustrates a fully assembled connector according to the present invention.

Figure 6:
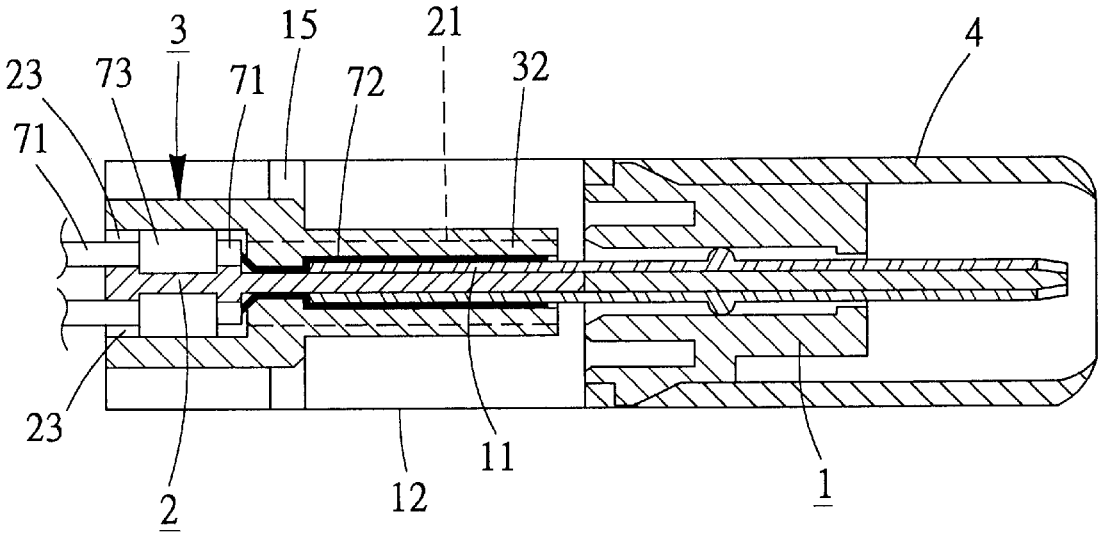
FIG. 6 is a sectional view of the connector of FIG. 3 taken along line A—A of FIG. 5.

Please refer to FIG. 6 that is a side sectional view taken on line A—A of FIG. 5. As shown, when the covers 3 are connected to the rear sections of the partitioning ribs 23 and form a unitary body, and the pressing ribs 32 forward projected from the covers 3 are connected to the front sections of the partitioning ribs 23 at two sides of the terminal slots 21 and form a unitary body, the bare conductors 72 are brought to tightly contact with and press against the rear ends of the insertion terminals 11 in the same terminal slot 21. Moreover, since each terminal slot 21 has only one bare conductor 72 and one insertion terminal 11 located therein, short circuits possibly occurring at contact points of the connector may be avoided.

Following are advantages of the connector according to the present invention:

1. Each bare conductor 72 in front of the interconnecting cables 7 is in a separate terminal slot 21 to tightly contact with one single insertion terminal 11 in the same terminal slot 21. Therefore, short circuits at contact points of the connector can be avoided.
2. The covers 3 fixedly connected to the plastic body 1 and the insertion body 2 ensure the fixed location of the bare conductors 72 in the individual terminal slots 21 without the risk of deviation therefrom. This arrangement not only protects the connector against short circuit at contact points but also allows simplified and faster manufacture of quality controlled connectors at reduced cost.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. An electrical connector comprising a plastic body, a steel case housing a front part of said plastic body, an insertion body assembled to a rear end of said plastic body, two covers, and two interconnecting cables symmetrically connected to upper and lower sides of said insertion body at a rear portion thereof;

said plastic body being provided at a front surface with upper and lower rows of alternately arranged insertion terminals and at two lateral sides with two rearward extended side walls that are formed at respective inner surface with a guiding rail having a retaining hole provided at a predetermined suitable position, and two vertically extended insertion slots being symmetrically provided at inner surfaces of said two side walls at the respective predetermined positions;

said insertion body being provided at top and bottom front surfaces with two rows of terminal slots corresponding to said insertion terminals on said plastic body and at two lateral sides of said insertion body with protrusions corresponding to said retaining holes in said guiding rails of said plastic body; said insertion body also being provided between adjacent rear ends of said terminal slots with partitioning ribs, two transverse receiving recesses being separately provided on upper and lower surfaces of said insertion body to divide said partitioning ribs into discontinued front and rear sections;

each of said interconnecting cables including a plurality of conductors that are arranged corresponding to said insertion terminals and fixed in place by clamping said conductors between two transversely extended clamping pieces, such that bared front ends of said conductors forward project from a front side of said clamping pieces, and said clamping pieces being suitable for positioned in said receiving recesses of said insertion body with said bared front ends of said conductors located in corresponding terminal slots on rear ends of said insertion terminals in the same said terminal slots; and said two covers being symmetrically formed and having at each lateral end a centered projection corresponding to said vertical insertion slot in said plastic body and each of said covers having a front edge including a plurality of forward projected pressing ribs corresponding to said terminal slots on said insertion body;

said insertion body being inserted into said plastic body with rear ends of said insertion terminals located in said terminal slots between front sections of two adjacent partitioning ribs, said clamping pieces with conductors clamped therebetween being set in said receiving recesses on said insertion body with said conductors separately located between two adjacent partitioning ribs and said bared front ends of said conductors located on and contacting with rear ends of said insertion terminals correspondingly located in said terminal slots, said two covers being located onto said clamping pieces with said lateral projections aligning with said vertical insertion slots on said plastic body and being received said recesses of said insertion body and said pressing ribs forward projected from said covers located in said terminal slots above said bared fronts of said conductors and said insertion terminals to tightly press said conductors together, and rear edges of said covers being firmly connected to rear sections of said partitioning ribs and said pressing ribs to said front sections of said partitioning ribs at two sides of said terminal slots by means of radio heating; whereby each bared front end of said conductors is located in one said terminal slot to tightly contact with only one said insertion terminal to free said connector from short circuits at contact points.

* * * * *